US005822811A

United States Patent [19]

Ko

[11] Patent Number: 5,822,811

[45] Date of Patent: Oct. 20, 1998

[54] EXTENSIBLE FAUCET STRUCTURE OF KITCHEN CABINET

[75] Inventor: Hsi-Chia Ko, Lu Kang, Changhua Hsien, Taiwan

[73] Assignee: Chung Cheng Faucet Co., Ltd., Taiwan

[21] Appl. No.: 908,049

[22] Filed: Aug. 11, 1997

[51] Int. Cl.[6] ..... E03C 1/04

[52] U.S. Cl. ..... 4/678; 4/675

[58] Field of Search ..... 4/678, 675, 676, 4/677, 695

[56] References Cited

U.S. PATENT DOCUMENTS

| | | | |
|---|---|---|---|
| 5,213,268 | 5/1993 | Gnauert et al. | 4/677 |
| 5,575,424 | 11/1996 | Fleischmann | 4/677 |
| 5,660,203 | 8/1997 | Gnauert et al. | 4/677 |

*Primary Examiner*—David J. Walczak
*Attorney, Agent, or Firm*—Bacon & Thomas

[57] ABSTRACT

An extensible faucet structure for a kitchen cabinet including a faucet body, a spout, a combination seat, an inner gasket seat, a panel, a locking nut, a pad member, two bolts and two locking trays. The faucet body includes a control handle disposed at an upper end thereof and a circular insertion mouth laterally extending from one side thereof. An insertion section is disposed at one end of the spout to which an extensible guide tube is connected. The combination seat is formed with an internal combination chamber. A bottom of the combination seat is disposed with a locating block formed with three thread holes on a bottom face thereof for communicating with the combination chamber. The three thread holes are respectively connected with a cold water incoming hose, a hot water incoming hose and an outgoing hose with different lengths. A thread socket is disposed on a plane cut face of the locating block. A projecting block with a stepped hole is disposed at an upper end of an inner edge of the gasket seat. Each locking tray has a central thread hole and an X-shaped projecting plate disposed on a bottom thereof. An open section is formed on a lateral side of the gasket seat. An outer thread section of less diameter extends downwardly from a bottom of the gasket seat. The panel is formed with a central hexagonal fitting hole and with two threaded seats on two sides of a bottom thereof.

2 Claims, 7 Drawing Sheets

EXTENSIBLE FAUCET STRUCTURE OF KITCHEN CABINET

BACKGROUND OF THE INVENTION

The present invention relates to an extensible faucet structure for a kitchen cabinet, in which the locking nut is easily screwed with the outer thread section of the gasket seat without obstacle. By two two bolts and locking trays, the faucet is easily mounted on the kitchen cabinet. The guide tube of the spout may be easily extended and retracted without being affected by the cold water incoming hose and the hot water incoming hose.

FIG. 1 shows a conventional faucet, structure of a kitchen cabinet, including a faucet body 11, a spout 12, a combination seat 13, an inner gasket seat 14, a panel 15, a gasket plate 16, a pad member 17 and a retaining plate 18. A control handle 111 is disposed at an upper end of the faucet body 11 and a polygonal insertion mouth 112 laterally extends from one side of the faucet body 11. The end of the spout 12 is disposed with an insertion section 121 corresponding to the insertion mouth 112. An extensible guide tube 122 is connected with the end of the spout 12. A movable nut 123 is fitted with the end of the guide tube 122. The combination seat 13 is formed with an internal combination chamber 131. The bottom thereof is connected by welding with a cold water incoming hose 132, a hot water incoming hose 133 and an outgoing hose 134. A sleeve 141 is disposed in the gasket seat 14. An open section 142 is formed on a lateral side of the sleeve 141. The center of the panel 15 is formed with a fitting hole 151. The top face of the gasket plate 16 is formed with a through hole 161 and an arch through hole 162. The center of the pad member 17 is formed with a through hole 171. The retaining plate 18 is U-shaped and formed with a circular hole at a middle section.

When assembled, the lower end of the gasket seat 14 is fitted and located in the fitting hole 151 of the panel 15. The gasket plate 16 is attached to the middle section of the bottom face of the panel 15. Then the combination seat 13 is passed downwardly and located in the gasket seat 14. The outgoing hose 134 is passed through the sleeve 141 and the through hole 161 of the gasket plate 16 outwardly to the lower side of the panel 15. The cold and hot incoming hoses 132, 133 are passed through the arch through hole 162 of the gasket plate 16 outwardly to the lower side of the panel 15. A locking nut 163 is moved along the outgoing hose 134 to fix the gasket plate 16. The faucet body 11 is assembled with the gasket seat 14 and the combination seat 13 with the insertion mouth 112 aligned with the open section 142 of the gasket seat 14. Then the guide tube 122 is conducted into the insertion mouth 112 through the open section 142 and the arch through hole 162 outwardly to the lower side of the panel 15. The insertion section 121 is inserted into the insertion mouth 112 and the pad member 17 is attached to the bottom of the panel 15. The cold water incoming hose 132, the hot water incoming hose 133, the outgoing hose 134 and the guide tube 122 are passed through the central through hole 171 to complete the assembly. Referring to FIG. 3, when mounted on the kitchen cabinet, the cold water incoming hose 132, the hot water incoming hose 133, the outgoing hose 134 and the guide tube 122 are passed through the fixing hole of the cabinet with pad member 17 alignedly attached to the cabinet. Then the outgoing hose 134 is fitted into the circular hole 181 of the retaining plate 18 with the cold water incoming hose 132, the hot water incoming hose 133 and the guide tube 122 received In a receptacle of the retaining plate 18. A nut 182 is then screwed with the outgoing hose 134. Finally, the cold water incoming hose 132 and the hot water incoming hose 133 are bent in accordance with the position of the cold and hot water connectors and the movable nut 123 of the guide tube 122 is screwed with the end of the outgoing hose 134 to complete the installation.

The above faucet structure has the following shortcomings:

1. When the locking nut 163 is moved along the outgoing hose 134 to fix the combination seat 13, the gasket seat 14 and the gasket plate 16 and when the nut 182 is screwed with the outgoing hose 134 to fix the retaining plate 18, the cold water incoming hose 132 and the hot water incoming hose 133 will from an obstacle to the locking operation.
2. After the cold water incoming hose 132 and the hot water incoming hose 133 are bent according to the positions of the cold and hot water connectors, the arch through hole 162 of the gasket plate 16 is narrowed. This makes it difficult to extend or retract the guide tube 122 of the spout 12.

SUMMARY OF THE INVENTION

It is therefore a primary object of the present invention to provide an extensible faucet structure for a kitchen cabinet in which when fixing the gasket seat on the panel, the locking nut is easily screwed with the outer thread section of the gasket seat without obstacle. In addition, by two bolts and two locking trays, the faucet is easily mounted on the kitchen cabinet.

It is a further object of the present invention to provide the above faucet structure in which after the cold and hot water incoming hoses are connected with the cold and hot water connectors, the guide tube of the spout may be easily extended and retracted without being affected by the cold and hot water incoming hoses.

The present invention can be best understood through the following description and accompanying drawings, wherein:

DETAILED DESCRIPTION OF THE PREFERRED EMBODIMENTS

Figure 1:
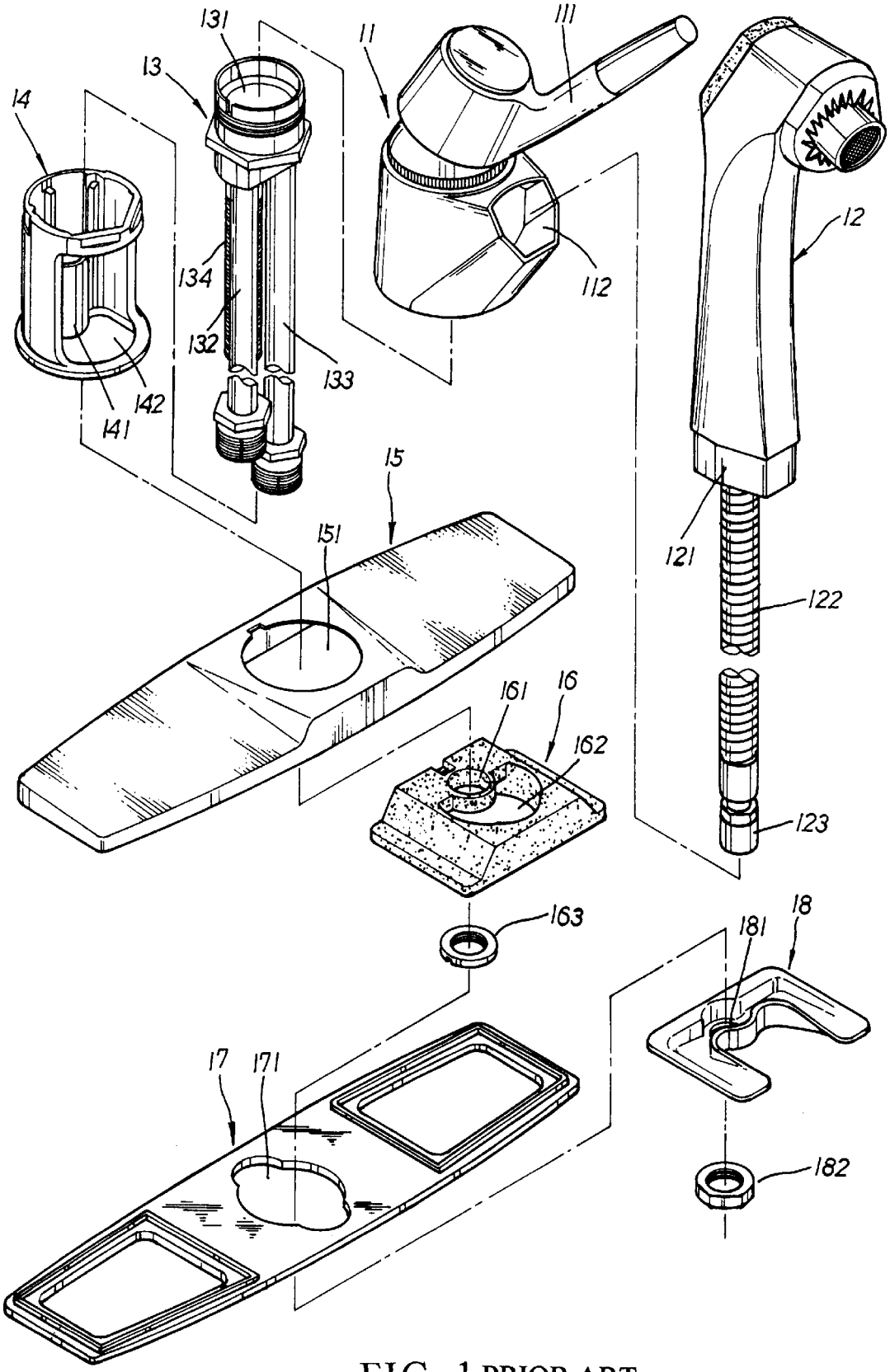
FIG. 1 PRIOR ART
FIG. 1 Is a perspective exploded view of a conventional faucet structure.
Figure 2:
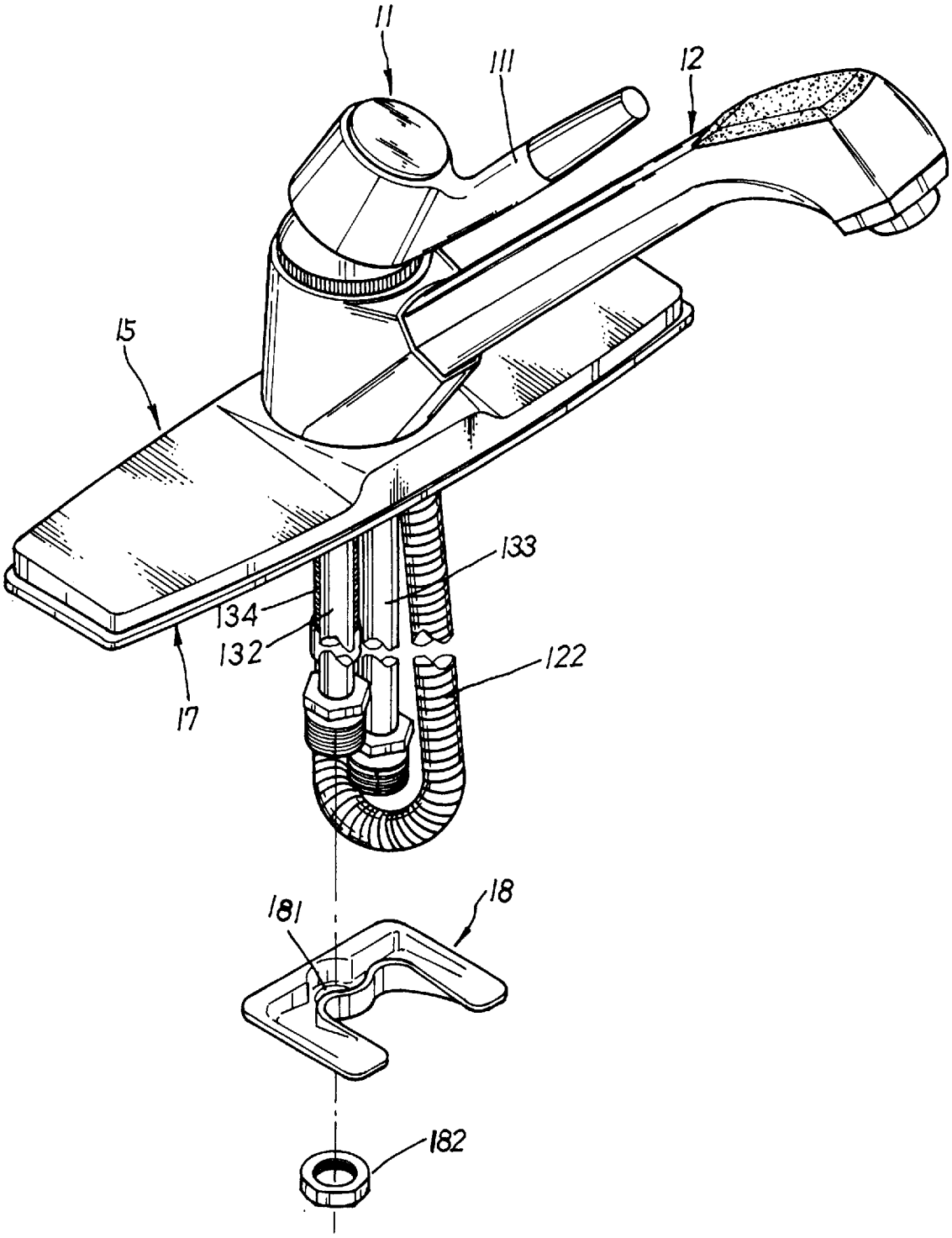
FIG. 2 PRIOR ART
FIG. 2 is a perspective assembled view according to FIG. 1.
Figure 3:
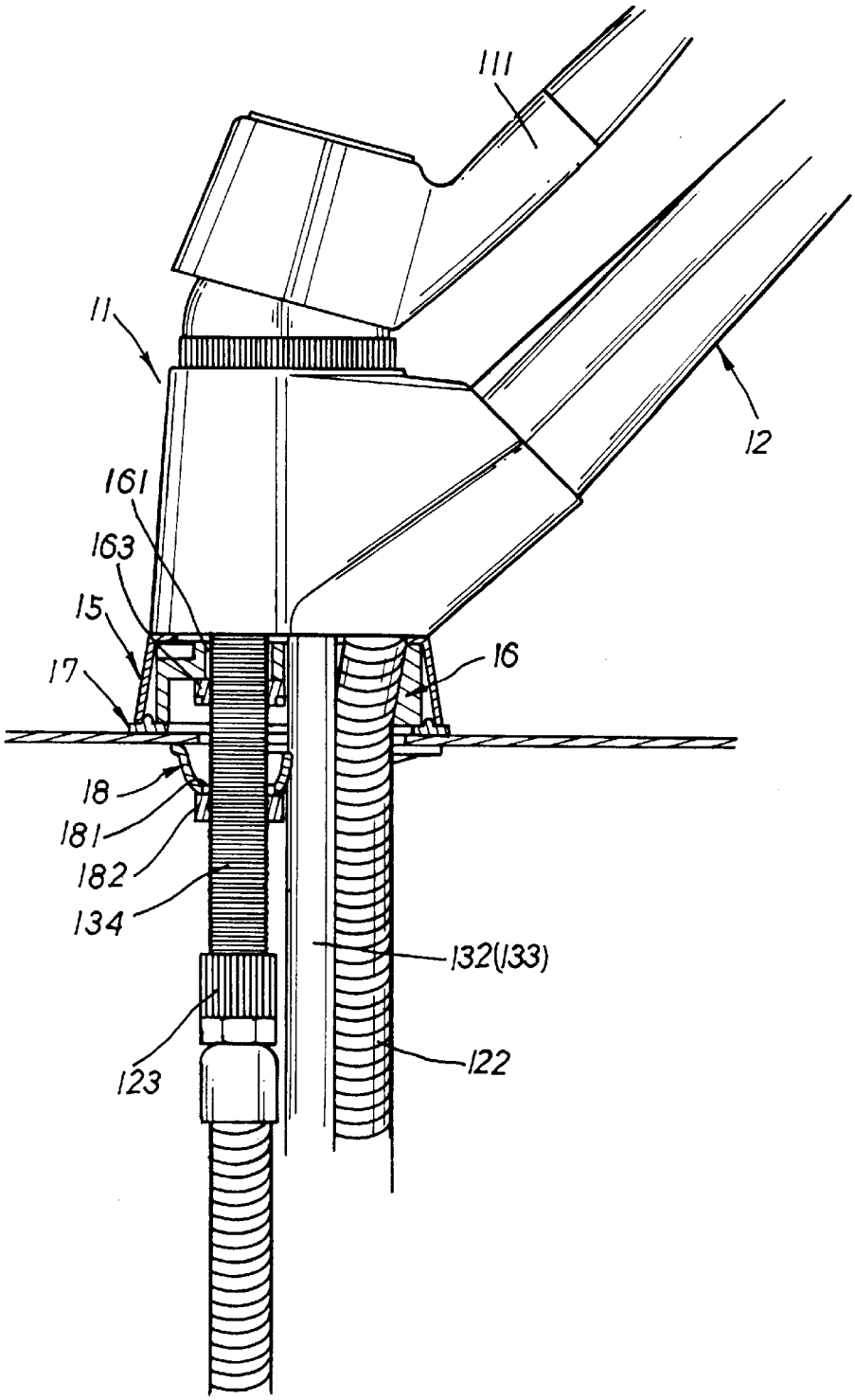
FIG. 3 PRIOR ART
FIG. 3 shows the installation of the conventional faucet structure.
Figure 4:
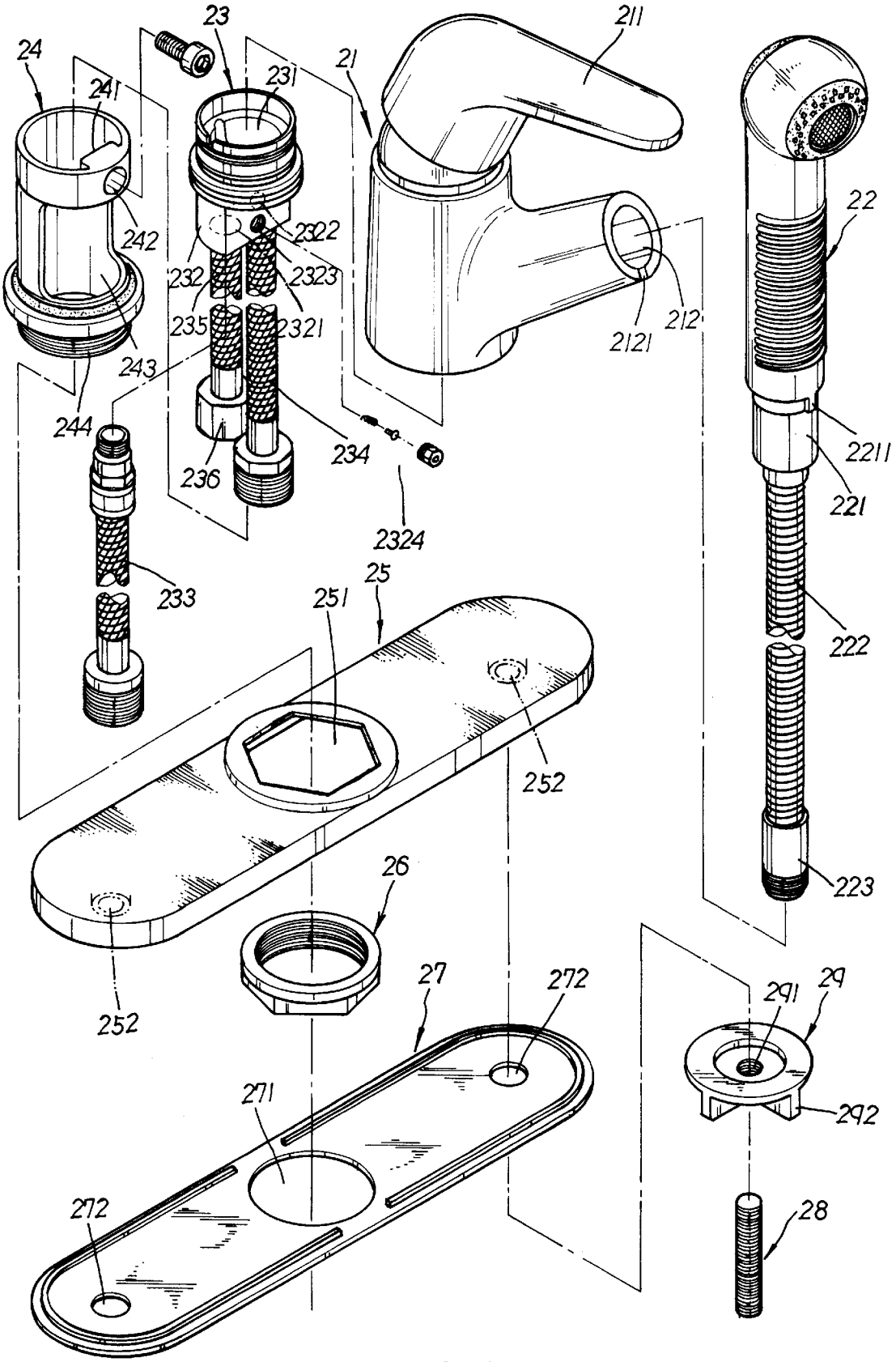
FIG. 4 is a perspective exploded view of the present invention.

Please refer to FIG. 4. The present invention includes a faucet body 21, a spout 22, a combination seat 23, an inner gasket seat 24, a panel 25, a locking nut 26, a pad member 27, two bolts 28 and two locking trays 29. A control handle 211 is disposed at an upper end of the faucet body 21 and a circular insertion mouth 212 laterally extends from one side of the faucet body 21. A locating notch 2121 is formed on the edge of the opening of the south 212. The end of the spout 22 is disposed with an insertion section 221 having a locating projection 2211 on the edge. An extensible guide tube 222 is connected with the end of the spout 22. A connector 223 with outer thread is connected with the end of the guide tube 222. The combination seat 23 is formed with an internal combination chamber 231. The bottom thereof is disposed with a locating block 232 formed with three thread holes 2321 on a bottom face thereof for communicating with the combination chamber 231. The three thread holes 2321 are respectively connected with a metal cold water incoming hose 233, a hot water incoming hose 234 and an outgoing hose 235 with different lengths. The end of the outgoing hose 235 is disposed with a movable nut 236. A plane cut face of the locating block 232 is disposed with a thread socket 2322 and a vacuum breaker receiving hole 2323 which is communicated with the thread hole 2321 connected with the outgoing hose 235. A vacuum breaker 2324 is connected with the receiving hole 2323 for avoiding back flow. The upper end of an inner edge of the inner gasket seat 24 is disposed with a projecting block 241 formed with a stepped hole 242 on an outer edge. An open section 243 is formed on a lateral side of the gasket seat 24. An outer thread section 244 of less diameter extends downwardly from the bottom of the gasket seat 24. The center of the panel 25 is formed with a hexagonal fitting hole 251. Two sides of the bottom face of the panel 25 are respectively formed with two thread seats 252. The center of the pad member 27 is formed with a through hole 271. Each side of the pad member 27 is formed with a circular hole 272. The locking tray 29 is formed with a central thread hole 291 and the bottom thereof is disposed with an X-shaped projecting plate 292.

Figure 5:
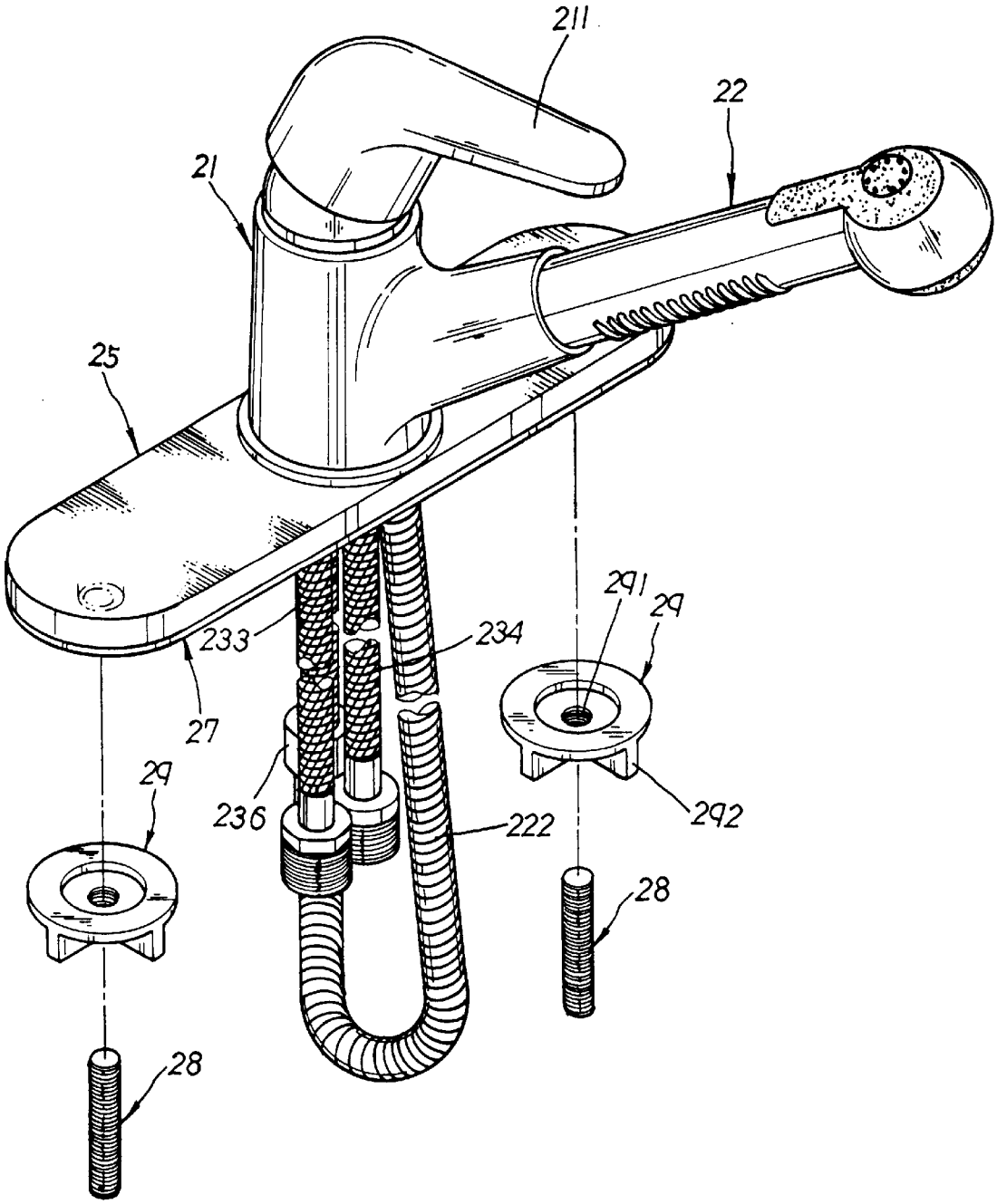
FIG. 5 Is a perspective assembled view according to FIG. 4.

Referring to FIG. 5, when assembled, the outer thread section 244 of the gasket seat 24 is passed through the hexagonal fitting hole 251 and tightened therein by the locking nut 26 so as to fix the gasket seat 24 on the panel 25. The combination seat 23 is then downwardly fitted into the gasket seat 24 with the locating projection 232 received in an inner upper section thereof and located by the projecting block 241. The cold water incoming hose 233, the hot water incoming hose 234 and the outgoing hose 235 are passed through the gasket seat 24 outwardly to the lower side of the panel 25. An inner hexagonal screw is passed through the stepped hole 242 of the gasket seat 24 and screwed in the thread socket 2322 of the locating projection 232 of the combination seat 23 so as to fixedly connect the combination seat 23 with the gasket seat 24. The faucet body 21 is assembled with the gasket seat 24 and the combination seat 23 with the insertion mouth 212 aligned with the open section 243 of the gasket seat 24. The guide tube 222 of the spout 22 is conducted into the insertion mouth 212 and the open section 243 of the gasket seat 24 outwardly to the lower side of the panel 25 with the insertion section 221 of the spout 22 inserted in the insertion mouth 212. The locating projection 2211 of the insertion section 221 is engaged in the locating notch 2121 of the insertion mouth 212 to locate the spout 22. The pad member 27 is attached to the bottom of the panel 25 and then the cold water incoming hose 233, the hot water incoming hose 234, the outgoing hose 235 and the guide tube 222 are passed through the central hole 271 of the pad member 27 to complete the assembly.

Figure 6:
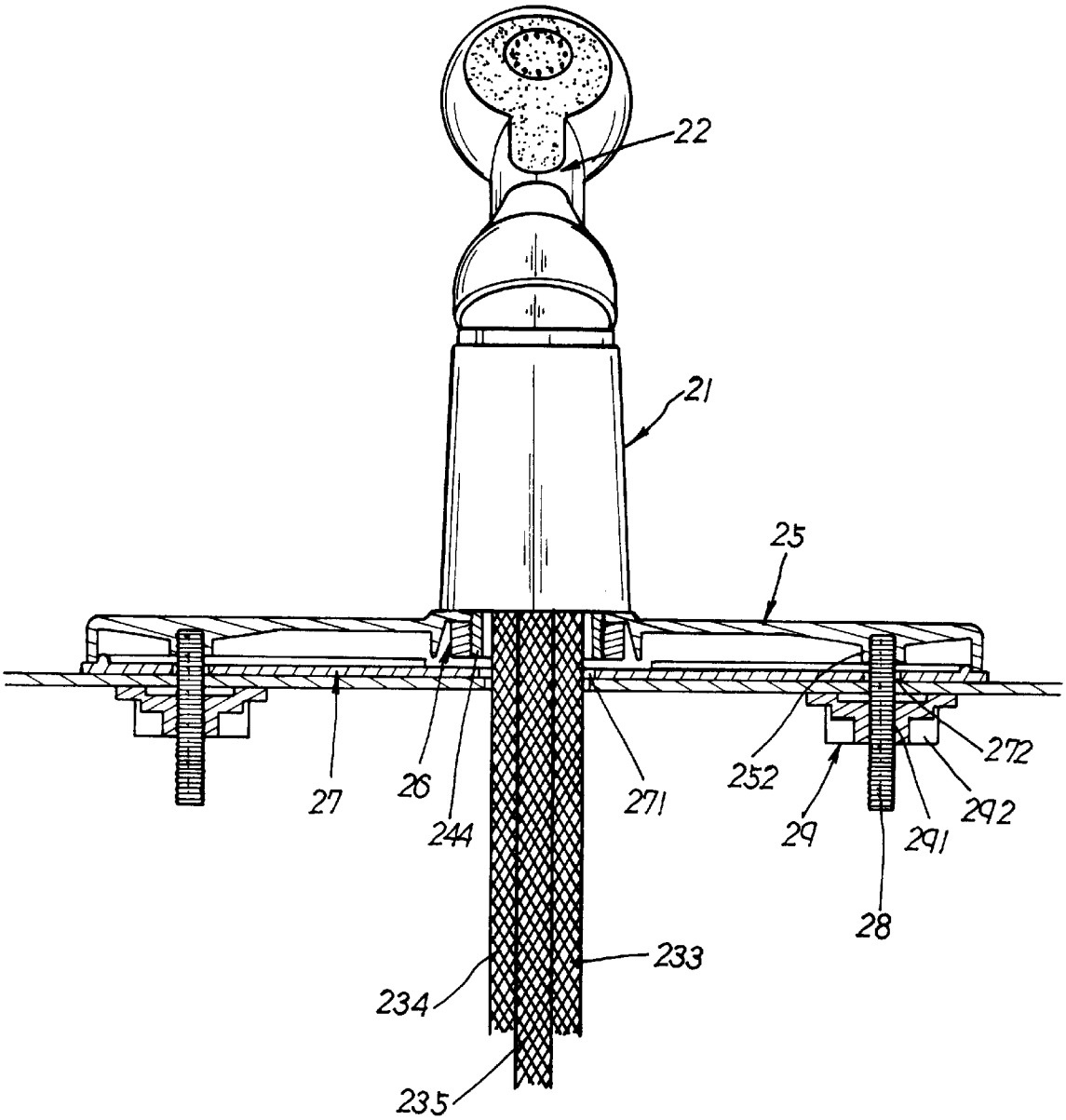
FIG. 6 shows the installation of the faucet structure of the present invention.

FIG. 6 shows the application of the present invention. When mounted on a kitchen cabinet, the cold water incoming hose 233, the hot water incoming hose 234, the outgoing hose 235 and the guide tube 222 are first passed through the fixing hole of the cabinet with the pad member 27 attached thereto. The bolts 28 are then passed through the through holes of the cabinet and the circular holes 272 of the pad member 27 to be tightened in the thread seats 252 of the panel 25. The locking tray 29 is held and rotated at the X-shaped projecting plate 292 so as to screw onto the bolts 28 in the thread holes 291 to abut against the bottom of the cabinet. Then the cold water incoming hose 233 and the hot water incoming hose 234 are connected with cold and hot water connectors and the connector 223 of the guide tube 222 is screwed with the movable nut 236 of the outgoing hose 235 to complete the installation.

Figure 7:
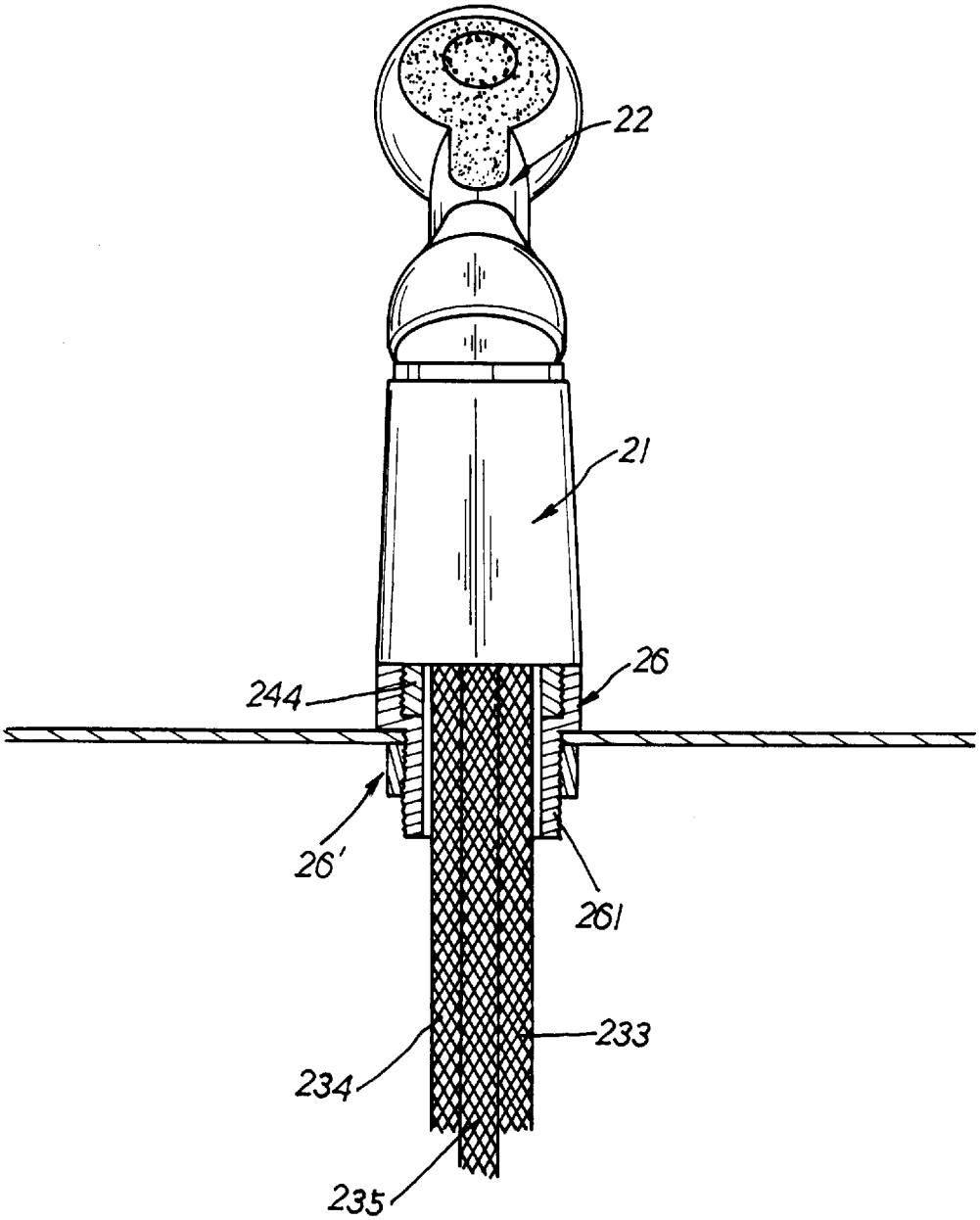
FIG. 7 shows another embodiment of the present invention.

FIG. 7 shows another embodiment of the present invention, in which the panel 25 and the pad member 27 are omitted. In this case, the bolts 28 and the locking trays 29 are no longer necessary and the locking nut 26 has a downwardly extending outer thread section 261 of smaller diameter. When assembled, the outer thread section 261 is passed through the fixing hole of the cabinet to be tightened by another locking nut 26' to abut against the bottom face of the cabinet.

The present invention has the following advantages:

1. The locking nut 26 is easily screwed with the outer thread section 244 of the gasket seat 24 without obstacle. In addition, by the bolts 28 and the locking trays 29, the faucet is easily mounted on the kitchen cabinet.
2. The guide tube 222 of the spout 22 may be easily extended and retracted without being affected by the cold water incoming hose 233 and the hot water incoming hose 234.

The above embodiments are only examples of the present invention and the scope of the present invention should not be limited to the examples. Any modification or variation derived from the examples should fall within the scope of the present invention.

What is claimed is:

1. An extensible faucet structure for a kitchen cabinet, said faucet structure comprising:

a faucet body;

a control handle disposed at an upper end of said faucet body;

a circular insertion mouth laterally extending from one side of said faucet body, said insertion mouth defining an opening with a locating notch formed on an edge thereof;

a spout with an insertion section disposed on one end thereof, said insertion section having a locating projection on an end thereof;

an extensible guide tube connected at one end to said one end of said spout;

a connector having outer threads connected to an opposite end of said guide tube;

a combination seat formed with an internal combination chamber;

an inner gasket seat with an opened section formed on a lateral side thereof;

a projection block disposed at an upper end of an inner edge of said gasket seat, said projection block being formed with a stepped hole on an outer edge thereof;

an outer thread section of less diameter extending downward from a bottom of said gasket seat;

a panel with a hexagonal fitting hole formed in a center thereof and two thread seats each formed on a respective side of a bottom face thereof;

a pad member with a through hole formed in a center thereof and a circular hole formed in each side thereof;

a locating block disposed on a bottom of said combination seat, said locating block including a thread socket disposed on a plane cut face thereof, said locating block being formed with three thread holes on a bottom face thereof for communication with said combination chamber, said three thread holes being respectively connected to a cold water incoming hose, a hot water incoming hose and an outgoing hose with different lengths, said outgoing hose including a movable nut disposed on one end thereof;

two locking trays each having a central thread hole and an X-shaped projecting plate disposed on a bottom thereof;

a locking nut; and two bolts;

wherein said outer thread section of said gasket seat is passed through said hexagonal fitting hole and tightened therein by said locking nut such that said gasket seat is fixed on said panel, said bolts are passed through two through holes of a cabinet and through said circular holes of said pad member and are tightened in said thread seats of said panel, and said locking trays are rotated at said X-shaped projecting plates about said bolts in said thread holes such that said locking trays abut a bottom of said cabinet.

2. An extensible faucet structure for a kitchen cabinet, said faucet structure comprising:

a faucet body;

a control handle disposed at an upper end of said faucet body;

a circular insertion mouth laterally extending from one side of said faucet body, said insertion mouth defining an opening with a locating notch formed on an edge thereof;

a spout with an insertion section disposed on one end thereof, said insertion section having a locating projection on an edge thereof;

an extensible guide tube connected at one end to said one end of said spout;

a connector having outer threads connected to an opposite end of said guide tube;

a combination seat formed with an internal combination chamber;

an inner gasket seat with an open section formed on a lateral side thereof;

a projection block disposed at an upper end of an inner edge of said gasket seat, said projection block being formed with a stepped hole on an outer edge thereof;

an outer thread section of less diameter extending downward from a bottom of said gasket seat;

a locating block disposed on a bottom of said combination seat, said locating block including a thread socket disposed on a plane cut face thereof, said locating block being formed with three thread holes on a bottom face thereof for communicating with said combination chamber, said three thread holes being respectively connected to a cold water incoming hose, a hot water incoming hose and an outgoing hose with different lengths, said outgoing hose including a movable nut disposed on one end thereof;

a first locking nut having a downwardly extending outer thread section of smaller diameter; and a second locking nut;

wherein said outer thread section of said gasket seat is tightened in said first locking nut and said outer thread section of said first locking nut is passed through a fixing hole of a cabinet and tightened by said second locking nut such that said second locking nut abuts a bottom face of said cabinet.

* * * * *